US008167677B2

(12) United States Patent
Huang

(10) Patent No.: US 8,167,677 B2
(45) Date of Patent: May 1, 2012

(54) METHOD OF ASSEMBLING AN AIRTIGHT LED LIGHT BULB

(75) Inventor: David Huang, Taipei (TW)

(73) Assignee: Liquidleds Lighting Corp., Taipei (TW)

( * ) Notice: Subject to any disclaimer, the term of this patent is extended or adjusted under 35 U.S.C. 154(b) by 4 days.

(21) Appl. No.: 12/853,367

(22) Filed: Aug. 10, 2010

(65) Prior Publication Data

US 2012/0040585 A1 Feb. 16, 2012

(51) Int. Cl.
*H01J 9/26* (2006.01)

(52) U.S. Cl. ..... 445/44; 445/22; 445/40

(58) Field of Classification Search ..... 445/22, 445/23, 26, 38, 40, 44; 313/51, 317, 318.01–318.12, 313/493, 573, 624, 625, 634
See application file for complete search history.

(56) References Cited

U.S. PATENT DOCUMENTS 6,064,155 A * 5/2000 Maya et al. ..... 315/56
7,053,554 B2 * 5/2006 Yasuda et al. ..... 313/634
7,976,211 B2 * 7/2011 Cao ..... 362/650
8,018,131 B2 * 9/2011 Tokes et al. ..... 313/493
2004/0017156 A1 * 1/2004 Yasuda et al. ..... 315/56
2008/0062703 A1 * 3/2008 Cao ..... 362/311
2008/0278057 A1 * 11/2008 Tokes et al. ..... 313/493
2009/0016062 A1 * 1/2009 Lee et al. ..... 362/294
2009/0021944 A1 * 1/2009 Lee et al. ..... 362/294
2010/0177522 A1 * 7/2010 Lee ..... 362/373
2010/0225218 A1 * 9/2010 Gray et al. ..... 313/46
2010/0314985 A1 * 12/2010 Premysler ..... 313/46
2010/0327725 A1 * 12/2010 Huang et al. ..... 313/46

* cited by examiner

*Primary Examiner* — Bumsuk Won
(74) *Attorney, Agent, or Firm* — Alan Kamrath; Kamrath IP Lawfirm, PA

(57) ABSTRACT

A method of assembling an airtight LED light bulb has the steps of: connecting a stem device with an LED device, drying the LED device, connecting the stem device with a bulb envelope, extracting air in the bulb envelope via a pipe, filling the bulb envelope with nitrogen or inert gas via the pipe, sealing an opening of the pipe which is located outside the bulb envelope to make the bulb envelope completely airtight and connecting a cap with the bulb envelope. Because the bulb envelope is airtight, moisture in the environment can not damage the LED device, and the steps of extracting air in the bulb envelope via the pipe and filling the bulb envelope with nitrogen or inert gas via the pipe are feasible. Consequently, the LED device will not easily be oxidized or dampened, so the lifespan of the airtight LED light bulb can be prolonged.

6 Claims, 6 Drawing Sheets

METHOD OF ASSEMBLING AN AIRTIGHT LED LIGHT BULB

BACKGROUND OF THE INVENTION

1. Field of the Invention

The present invention relates to a method of assembling a light bulb, and more particularly to a method of assembling an airtight LED light bulb.

2. Description of Related Art

With reference to FIG. 6, a conventional LED light bulb has a heat-sink housing 60, an LED device, a bulb envelope 70, a stem device and a cap 80. The heat-sink housing 60 is made of metal, has a top edge and is used to dissipate heat generated from the LED device. The bulb envelope 70 is securely combined with the top edge of the heat-sink housing 60. The LED device is mounted in the heat-sink housing 60 and the bulb envelope 70. The stem device is securely connected with the LED device and is detachably mounted in the heat-sink housing 60. The cap 80 is mounted securely around the stem device. However, the conventional LED light bulb has the following drawbacks.

1. Easy Damage to the LED Device:

Because the heat-sink housing 60 and the bulb envelope 70 are combined with each other with glue, gaps may be formed between the heat-sink housing 60 and the bulb envelope 70. Gaps may also be formed between the stem device and the heat-sink housing 60, because the stem device is detachably mounted in the heat-sink housing 60. The moisture in the environment may enter the LED light bulb and damage the LED device via the gaps, and the reliability of the LED device is reduced. The PCB or conductors of the LED device are easily oxidized or dampened. Consequently, the lifespan of the LED light bulb is shortened.

2. Weak Versatility of the Heat-Sink Housing 60:

A shape of the heat-sink housing 60 has to correspond to that of the bulb envelope 70 to facilitate the assembly of the heat-sink housing 60 and the bulb envelope 70. However, to change the shape of the heat-sink housing 60 requires new molds, and this increases manufacturing cost and is not versatile.

3. Inefficient Illumination:

A coating of an inner surface of the bulb envelope 70 helps light reflection and enhances illumination. However, a surface area of the inner surface of the bulb envelope 70 is small, and the heat-sink housing 60 blocks part of light. Accordingly, the illumination of the conventional LED light bulb is inefficient.

4. Poor Insulation:

The heat-sink housing 60 is usually made of metal to help dissipate heat. However, the metallic heat-sink housing 60 is not insulating, may cause users to get an electric shock and is not safe.

To overcome the shortcomings, the present invention provides a method of assembling an airtight LED light bulb to obviate the aforementioned problems.

SUMMARY OF THE INVENTION

The main objective of the invention is to provide a method of assembling an airtight LED light bulb.

A method of assembling an airtight LED light bulb has the steps of: connecting a stem device with an LED device, drying the LED device, connecting a stem device with a bulb envelope, extracting air in the bulb envelope via a pipe, filling the bulb envelope with nitrogen or inert gas via the pipe, sealing an opening of the pipe which is located outside the bulb envelope to make the bulb envelope completely airtight and connecting a cap with the bulb envelope. Because the bulb envelope is airtight, moisture in the environment can not damage the LED device, and the steps of extracting air in the bulb envelope via the pipe and filling the bulb envelope with nitrogen or inert gas via the pipe are feasible. Consequently, the LED device will not easily be oxidized or dampened, so the lifespan of the LED light bulb can be prolonged.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
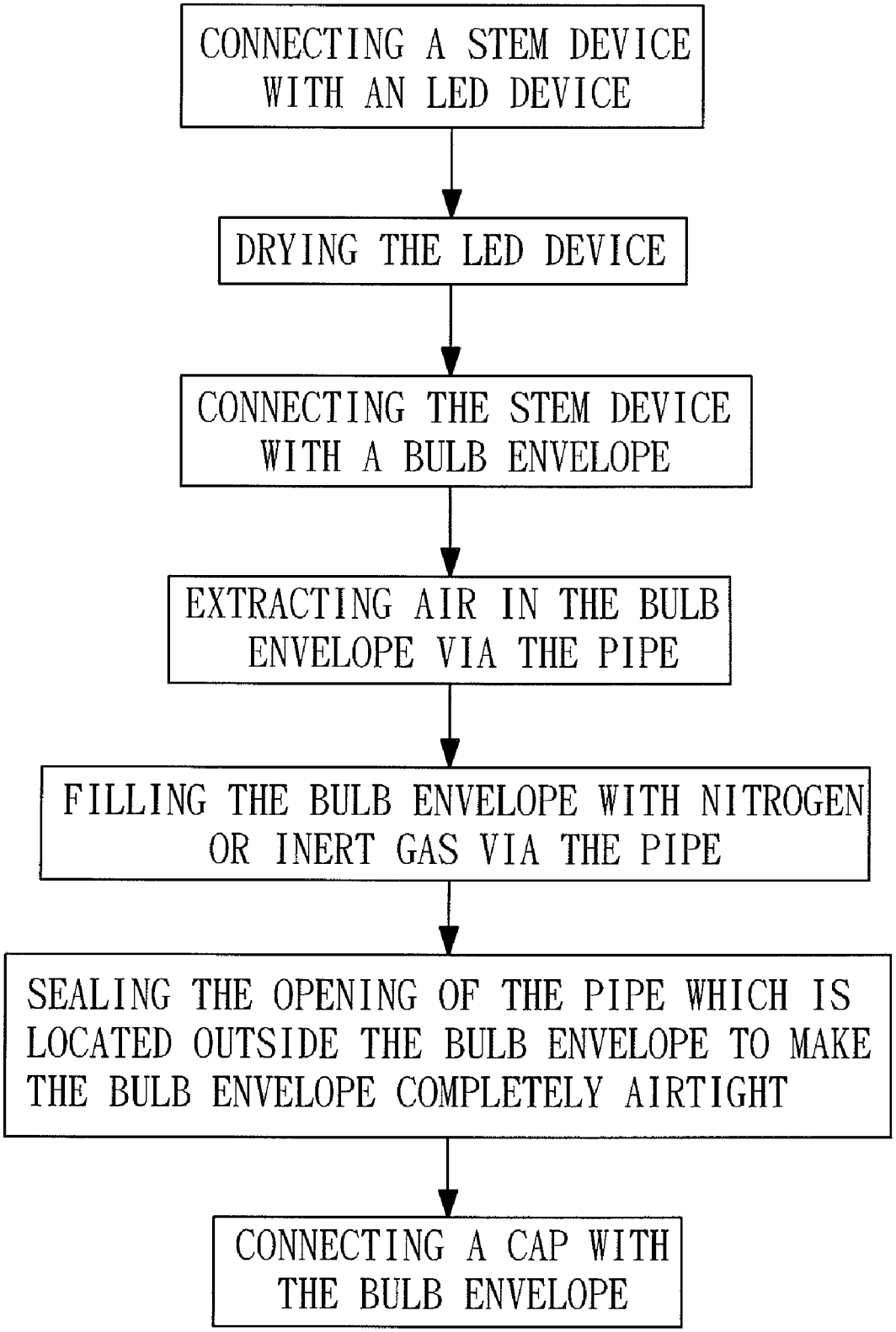
FIG. 1 is a block diagram of steps of a method of assembling an airtight LED light bulb in accordance with the present invention.
Figure 2:
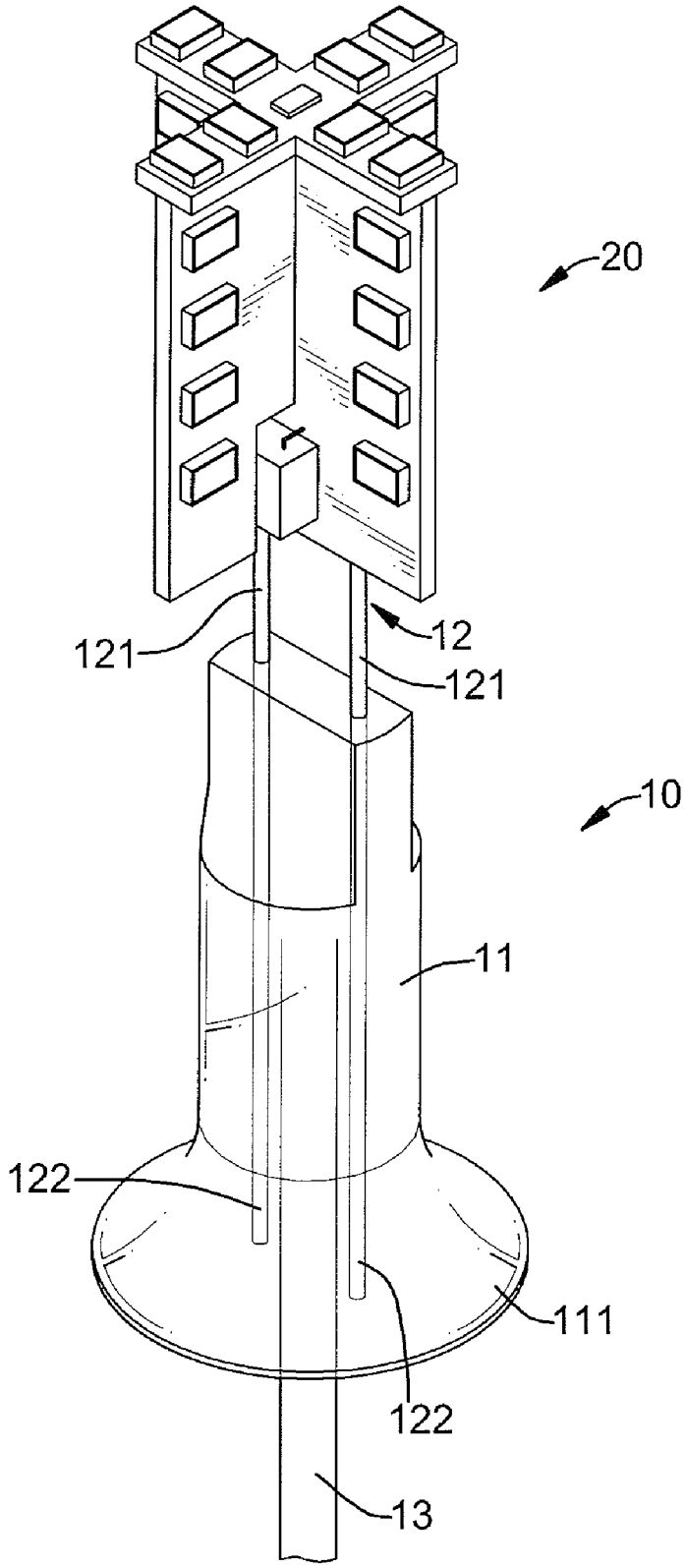
FIG. 2 is a perspective view of a stem device connected with an LED device of the airtight LED light bulb made in FIG. 1.
Figure 3:
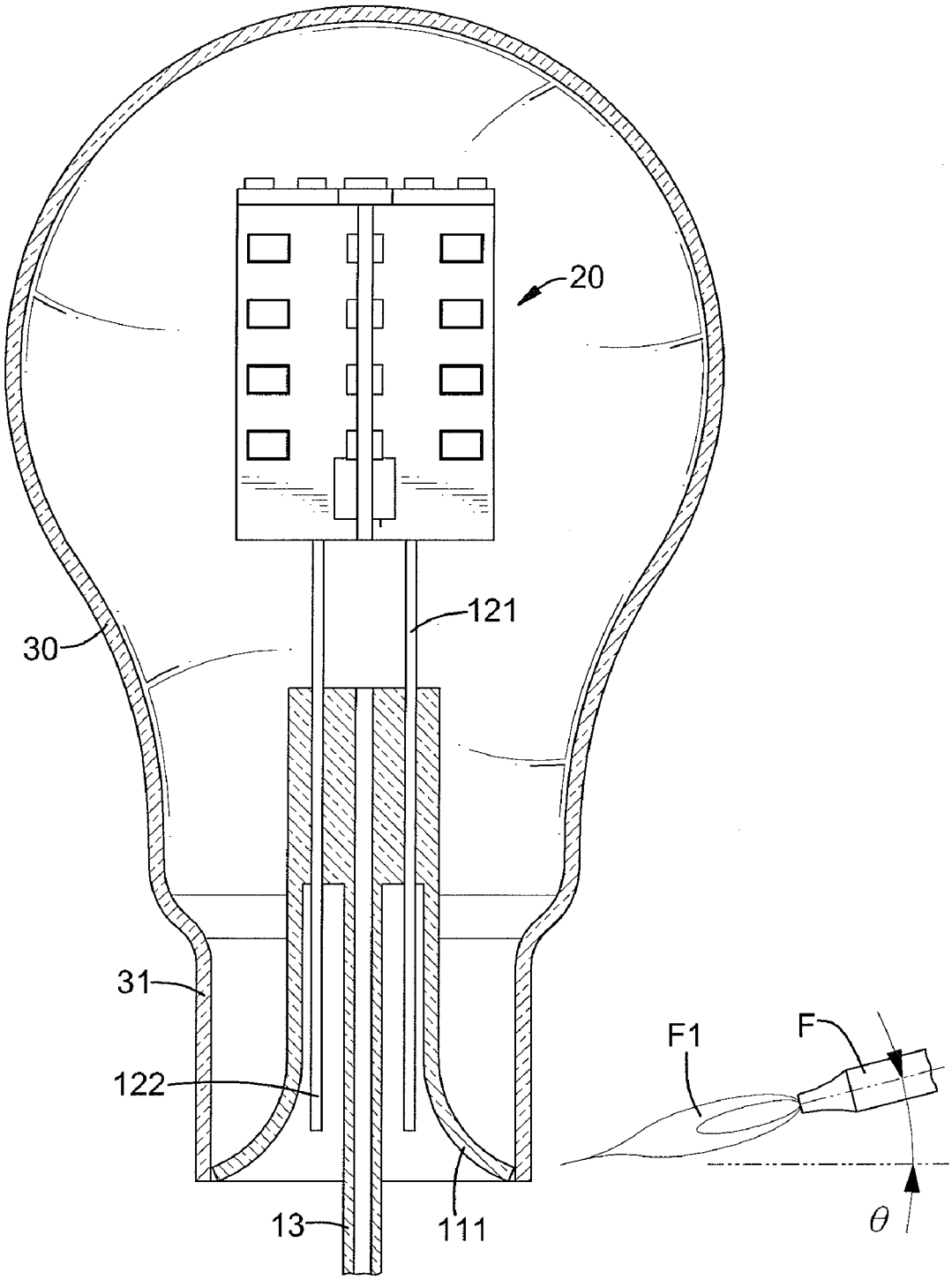
FIG. 3 is an operational side view in partial section of the airtight LED light bulb in FIG. 1 showing the step of connecting the stem device with a bulb envelope, wherein the bulb envelope is stood and the torch is tilted downwards slightly.

With reference to FIGS. 1 to 3, a method of assembling an airtight LED light bulb in accordance with the present invention comprises the following steps:

Connecting a Stem Device 10 with an LED Device 20:

A stem device 10 is connected with an LED (Light Emitting Diode) device 20. The stem device 10 has a base 11, two wires 12 and a pipe 13. The base 11 is made of glass, is hollow and has a first end, a second end and a flange 111. The second end of the base 11 is opposite to the first end of the base 11. The flange 111 is funnel-shaped and radially protrudes from the second end of the base 11.

The wires 12 are respectively mounted though the base 11, and each wire 12 has a supporting end 121 and a connecting end 122. The supporting ends 121 of the wires 12 are mounted outside and securely on the first end of the base 11 and are made of steel. The connecting ends 122 of the wires 12 are adjacent to the flange 111. The pipe 13 is made of glass, is securely mounted in and protrudes out from the base 11 and has two opposite openings.

The LED device 20 is mounted securely on and electrically connected with the supporting ends 121 of the wires 12 and has at least one LED. Because the supporting ends 121 are made of steel, the wires 12 can support the LED device 20 stably.

Figure 6:
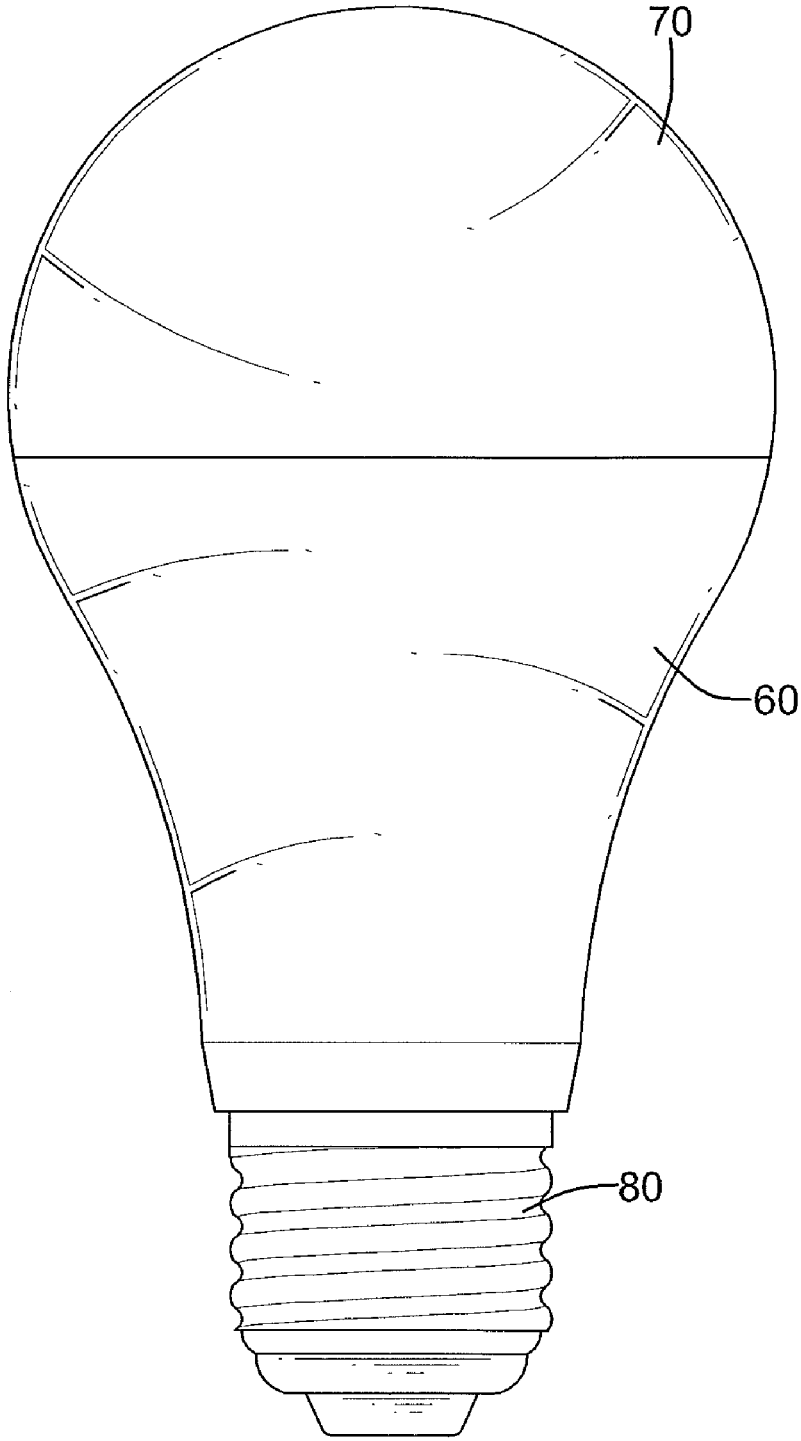
FIG. 6 PRIOR ART
FIG. 6 is a side view of a conventional LED light bulb in accordance with the prior art.

Drying the LED Device 20:

The LED device 20 is dried to reduce the moisture of the LED device 20. Because the moisture absorbed by the LED device 20 will vaporize and condense to cause damage to the LED device 20 and to shorten a lifespan of the LED device 20, the step evaporates water in the LED device 20 before being assembled. The step of drying the LED device 20 is not processed and useless in a method of assembling a conventional LED light bulb, because moisture in the environment still can damage the LED device via gaps between the heat-sink housing 60 and the bulb envelope 70 as shown in FIG. 6.

Preferably, the time of drying the LED device 20 ranges from 10 to 15 minutes, and the temperature of drying the LED device 20 ranges from 120 to 125 degree Celsius.

Connecting the stem device 10 with a bulb envelope 30:

A bulb envelope 30 is prepared, and the LED device 20 is put in the bulb envelope 30. The bulb envelope 30 is hollow, is made of glass and has an end and a neck 31. The neck 31 is formed at the end of the bulb envelope 30 and has an opening. The opening of the neck 31 is axially formed through the neck 31, and the LED device 20 is put in the bulb envelope 30 via the opening of the neck 31. When the LED device 20 is inserted into the bulb envelope 30 via the opening of the neck 31, the flange 111 abuts the neck 31. The flange 111 and the neck 31 are melted by a flame F1 of a torch F with the bulb envelope 30 and the stem device 10 being simultaneously rotated, such that the flange 111 and the neck 31 are seamlessly connected securely with each other. One of the openings of the pipe 13 is located outside the bulb envelope 30, and an inner space of the bulb envelope 30 communicates with the environment via the openings of the pipe 13.

Preferably, with further reference to FIG. 3, the bulb envelope 30 is stood, and the torch F is tilted downwards slightly. The flame F1 aims at the flange 111 (assuming the flame F1 is straight jetted out along a line which the torch F is located). A flame angle θ is defined as an angle between the flame F1 and a horizontal line at which the flange 111 is located. Preferably, the flame angle θ ranges from 5° to 15°. Because the flame F1 is tilted downwards, a temperature distribution of the bulb envelope 30 and the stem device 10 is changed to prevent the LED device 20 from being burnt out.

Figure 4:
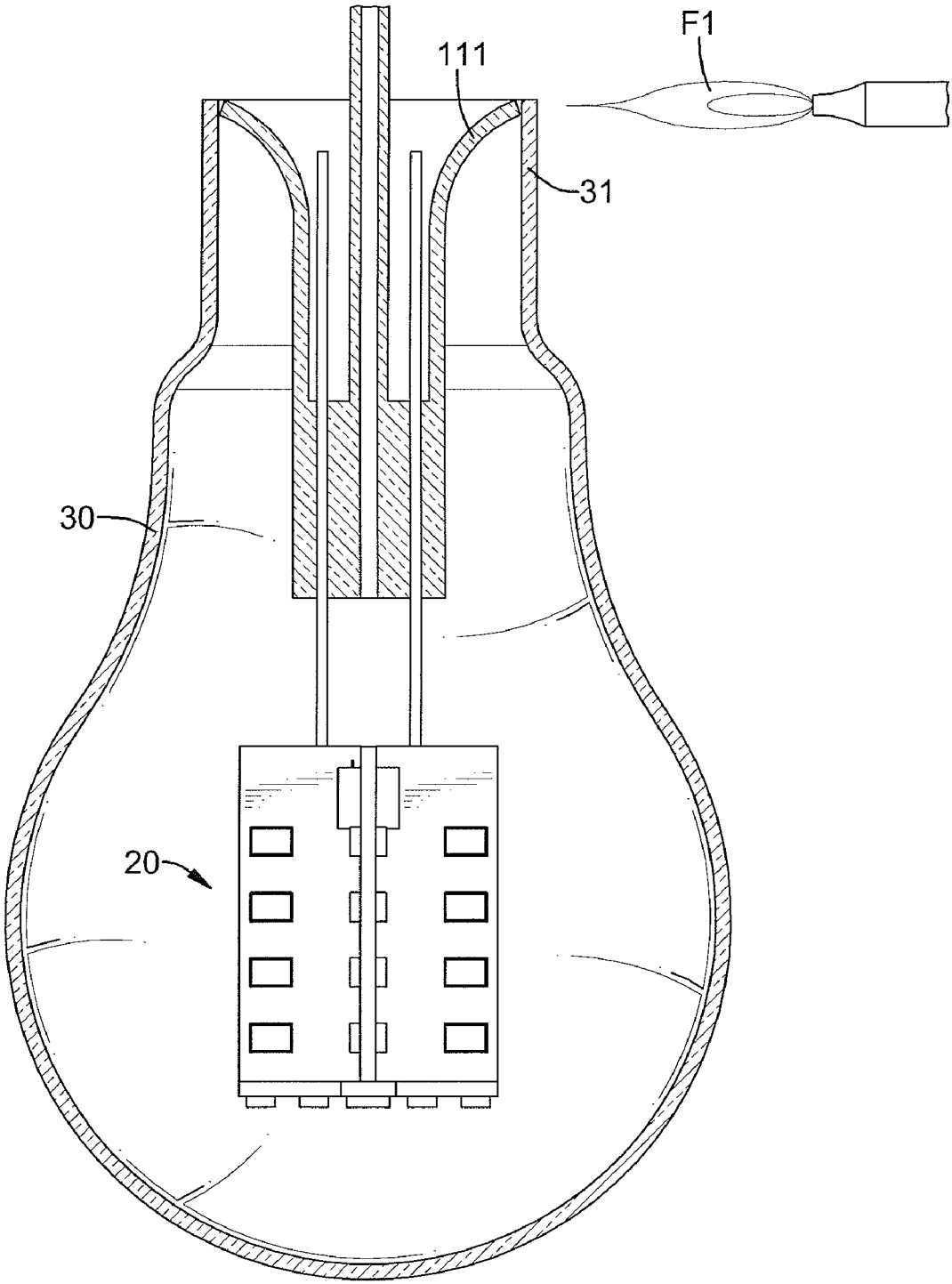
FIG. 4 is an operational side view in partial section of the airtight LED light bulb in FIG. 1 showing an alternative step of connecting the stem device with a bulb envelope, wherein the bulb envelope is stood upside down and the torch is mounted latitudinally.
Figure 5:
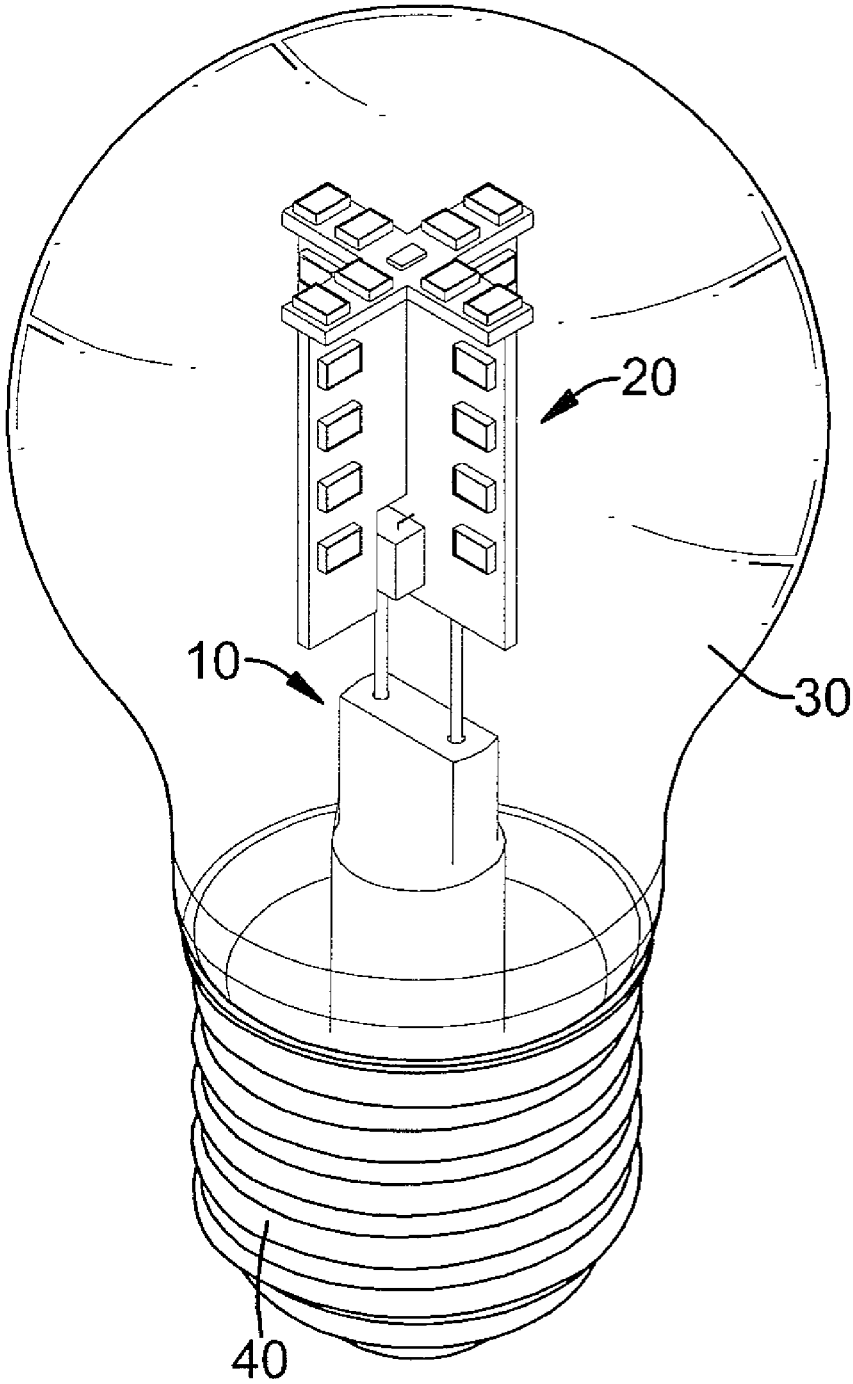
FIG. 5 is a perspective view of the airtight LED light bulb in FIG. 1 showing a cap combined with the bulb envelope to form a finished airtight LED light bulb.

Alternatively, with reference to FIG. 4, the bulb envelope 30 is stood upside down, and the torch F is mounted latitudinally, and the flame F1 aims at the flange 111. When the flame F1 melts the flange 111, air in the bulb envelope 30 is also heated up. Accordingly, air in the upside-down bulb envelope 30 will not connect to flow toward and damage the LED device 20.

Extracting Air in the Bulb Envelope 30 Via the Pipe 13:

Air in bulb envelope 30 is extracted via the pipe 13.

Filling the Bulb Envelope 30 with Nitrogen or Inert Gas Via the Pipe 13:

The bulb envelope 30 is filled with nitrogen or inert gas, such as neon and argon, via the pipe 13. Nitrogen or inert gas can reduce the risk of oxidization of the LED device 20, can prolong the lifespan of the LED device 20 and can facilitate to dissipate heat generated from the LED device 20. Consequently, the conventional heat-sink housing 60 is not necessary. Because the bulb envelope 30 is airtight, the steps of extracting air in the bulb envelope 30 via the pipe 13 and filling the bulb envelope 30 with nitrogen or inert gas via the pipe 13 are feasible.

Sealing the Opening of the Pipe 13 which is Located Outside the Bulb Envelope 30 to Make the Bulb Envelope 30 Completely Airtight:

The pipe 13 is melted by the flame F1 to seal the opening of the pipe 13 which is located outside the bulb envelope 30 to make the bulb envelope 30 completely airtight.

Connecting a Cap 40 with the Bulb Envelope 30:

A cap 40 is mounted securely around the neck 31 with glue to be connected securely with the envelope 30. The cap 40 is electrically connected with the connecting ends 122 of the wires 12 according to corresponding electrodes.

From the above description, it is noted that the present invention has the following advantages:

1. The Bulb Envelope 30 is Airtight:

Because the bulb envelope 30 is made of glass as a whole and seamless, the stem device 10 is seamlessly connected with the bulb envelope 30, the opening of the pipe 13 is sealed, and the bulb envelope 30 is completely airtight. Because the bulb envelope 30 is airtight, moisture in the environment can not damage the LED device 20 and the steps of extracting air in the bulb envelope 30 via the pipe 13 and filling the bulb envelope 30 with nitrogen or inert gas via the pipe 13 are feasible. Consequently, the LED device 20 will not easily be oxidized or dampened, the lifespan of the airtight LED light bulb can be prolonged and the reliability of the airtight LED light bulb can be enhanced.

2. Excellent Versatility of the Bulb Envelope 30:

Because the bulb envelope 30 is made of glass as a whole, a shape of the bulb envelope 30 can be easily changed after the glass bulb envelope 30 is heated. Moreover, the shape of the bulb envelope 30 is versatile to fit different caps 40.

3. Efficient Illumination:

A coating of an inner surface of the bulb envelope 30 is not necessary, because a surface area of the inner surface of the bulb envelope 30 is large enough to let light project out widely. Moreover, light emitted from the LED device 20 is not blocked by the heat-sink housing 60, so the airtight LED light bulb made by the method of assembling an airtight LED light bulb in accordance with the present invention has an efficient illumination.

4. Excellent Insulation:

Because the airtight LED light bulb does not have the conventional heat-sink housing 60 and is made of glass, the insulating airtight LED light bulb prevents users from getting an electric shock and is safe.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of assembling an airtight LED light bulb comprising:

connecting a stem device with an LED device, wherein the stem device is connected with the LED device having at least one LED and has a hollow base made of glass and having a first end;

a second end opposite to the first end of the base; and a flange radially protruding from the second end of the base;

two wires respectively mounted though the base, with each wire having a supporting end mounted outside and securely on the first end of the base and electrically connected securely with the LED device; and a connecting end adjacent to the flange; and a pipe made of glass, securely mounted in and protruding out from the base and having two opposite openings;

drying the LED device;

connecting the stem device with a bulb envelope, wherein the bulb envelope is hollow, is made of glass as a whole and has an end; and a neck formed at the end of the bulb envelope, abutting the flange and having an opening axially formed through the neck;

the flange and the neck are melted by a flame of a torch with the bulb envelope and the stem device being simultaneously rotated with the flange and the neck seamlessly connected securely with each other; and one of the openings of the pipe is located outside the bulb envelope to communicate an inner space of the bulb envelope with the environment via the openings of the pipe;

extracting air in the bulb envelope via the pipe;

filling the bulb envelope with nitrogen or inert gas via the pipe;

sealing the opening of the pipe which is located outside the bulb envelope to make the bulb envelope completely airtight; and connecting a cap with the bulb envelope, wherein the cap is mounted securely around the neck and is electrically connected with the connecting ends of the wires according to corresponding electrodes.

2. The method of assembling an airtight LED light bulb as claimed in claim 1, wherein in drying the LED device, a time of drying the LED device ranges from 10 to 15 minutes and a temperature of drying the LED device ranges from 120 to 125 degree Celsius.

3. The method of assembling an airtight LED light bulb as claimed in claim 2, wherein in connecting the stem device with the bulb envelope, the bulb envelope is stood upside down, the torch is mounted latitudinally and the flame aims at the flange.

4. The method of assembling an airtight LED light bulb as claimed in claim 2, wherein in connecting the stem device with the bulb envelope, the bulb envelope is stood, the torch is tilted downwards and the flame aims at the flange; a flame angle is defined as an angle between the flame and a horizontal line at which the flange is located; and the flame angle ranges from 5° to 15°.

5. The method of assembling an airtight LED light bulb as claimed in claim 1, wherein in connecting the stem device with the bulb envelope, the bulb envelope is stood upside down, the torch is mounted latitudinally and the flame aims at the flange.

6. The method of assembling an airtight LED light bulb as claimed in claim 1, wherein in connecting the stem device with the bulb envelope, the bulb envelope is stood, the torch is tilted downwards and the flame aims at the flange; a flame angle is defined as an angle between the flame and a horizontal line at which the flange is located; and the flame angle ranges from 5° to 15°.

* * * * *